US007135814B2

(12) United States Patent
Jung et al.

(10) Patent No.: US 7,135,814 B2
(45) Date of Patent: Nov. 14, 2006

(54) ELECTRON GUN FOR CATHODE RAY TUBE HAVING SVM COIL AND CATHODE RAY TUBE HAVING THE ELECTRON GUN

(75) Inventors: Bong-Wook Jung, Suwon-si (KR); Deog-Ho Kim, Suwon-si (KR); Kwang-Jin Yun, Suwon-si (KR); Se-Ja-Chul Hwang, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 11/068,635

(22) Filed: Feb. 26, 2005

(65) Prior Publication Data

US 2005/0189862 A1 Sep. 1, 2005

(30) Foreign Application Priority Data

Feb. 26, 2004 (KR) ..... 10-2004-0012952

(51) Int. Cl.
*H01J 29/46* (2006.01)

(52) U.S. Cl. ..... 313/452

(58) Field of Classification Search ..... 313/446–452
See application file for complete search history.

(56) References Cited

U.S. PATENT DOCUMENTS 6,617,777 B1 * 9/2003 Taguchi et al. ..... 313/412
6,624,559 B1 * 9/2003 Suzuki et al. ..... 313/414
6,952,077 B1 * 10/2005 Park et al. ..... 313/414
2002/0109452 A1 * 8/2002 Hwang et al. ..... 313/414

FOREIGN PATENT DOCUMENTS

JP 55-146847 11/1980
JP 2000-188607 7/2000

OTHER PUBLICATIONS

Patent Abstract of Japan, Publication No. 55-1468847, Published on Nov. 15, 1980, in the name of Yamauchi.
Patent Abstract of Japan, Publication No. 2000-188607, Published on Jul. 4, 2000, in the name of Harada.

* cited by examiner

*Primary Examiner*—Joseph Williams
*Assistant Examiner*—Hana Sanei
(74) *Attorney, Agent, or Firm*—Christie, Parker & Hale LLP

(57) ABSTRACT

An electron gun for a cathode ray tube having a scanning velocity modulation coil mounted on an outer circumference of a neck of the cathode ray tube. The electron gun includes a cathode for emitting electron beams; a plurality of grid electrodes sequentially mounted starting from the cathode, and including a plurality of focus electrodes mounted with a predetermined gap therebetween; supports on which the grid electrodes are fixed in a row; and a shield electrode mounted between the focus electrodes and connected to the focus electrodes. The shield electrode defines a continuous space along an elongated axis direction of the cathode ray tube.

32 Claims, 8 Drawing Sheets

ELECTRON GUN FOR CATHODE RAY TUBE HAVING SVM COIL AND CATHODE RAY TUBE HAVING THE ELECTRON GUN

CROSS-REFERENCE TO RELATED APPLICATION

This application claims priority of Korean Patent Application number 2004-0012952, filed Feb. 26, 2004, the entire disclosure of which is incorporated herein by reference.

BACKGROUND OF THE INVENTION (a) Field of the Invention

The present invention relates to a cathode ray tube (CRT). More particularly, the present invention relates to a CRT having a scanning velocity modulation (SVM) coil, and to an electron gun applied to this CRT.

(b) Description of the Related Art

A CRT typically includes a panel, a funnel, and a neck, which are integrally fused to define an exterior of the CRT. A phosphor screen is formed on an interior surface of the panel. Also, an electron gun, which emits electron beams toward the phosphor screen, is mounted within the neck. The funnel is positioned between the panel and the neck, and has a deflection yoke mounted to an outer circumference thereof for deflecting the electron beams emitted from the electron gun.

A configuration in which an SVM coil is mounted on an outer circumference of the neck of the CRT is well known (e.g., the projection-type CRT). The SVM coil synchronizes the electron beams passing through electrodes of the electron gun with image signals applied to the CRT to deflect the electron beams, thereby improving the resolution around edges of the image realized on the phosphor screen. The SVM coil is generally comprised of two saddle-shaped coils that are connected in series.

FIG. 9 is a partial sectional view showing a conventional structure of a CRT having an SVM coil. As shown, the direction to the left in the drawing is the direction toward the electron gun, and the direction to the right in the drawing is the direction toward a panel.

An electron gun 1 includes a cathode 3 that emits electron beams. The electron gun 1 also includes a plurality of grid electrodes G1, G2, G3, G4, and G5 (hereinafter referred to as first, second, third, fourth, and fifth grid electrodes, respectively) that focus and accelerate the electron beams emitted from the cathode 3. A bead glass 5 aligns and fixes the first, second, third, fourth, and fifth grid electrodes G1, G2, G3, G4, and G5 in this sequence.

The first and second grid electrodes G1 and G2 have a short length in an axial direction Z of the CRT, while the third and fourth grid electrodes G3 and G4 are cylindrical and have a longer length in the axial direction Z relative to the first and second grid electrodes G1 and G2. The fourth grid electrode G4 acts as a focusing electrode that focuses electron beams. An SVM coil 7 is mounted to an outer circumference of a neck 9 at a position approximately corresponding to the location of the fourth grid electrode G4.

In the CRT structured as in the above, the SVM coil 7 applies a deflection magnetic field to the electron beams generated by the electron gun 1 so that the electron beams perform scanning in a favorable state to desired locations of a phosphor screen (not shown). However, with such a structure, the SVM magnetic field does not directly act upon the electron beams, and instead is partially blocked by the fourth grid electrode G4 such that its strength is reduced. Therefore, the electron beam position is unable to be precisely controlled.

Furthermore, an eddy current is generated on a surface of the fourth grid electrode G4 by the SVM magnetic field passing through the fourth grid electrode G4. This further weakens the magnetic field acting on the electron beams. The eddy current is directly proportional to a surface area of the electrode that blocks the magnetic field.

In an attempt to remedy these problems, Japanese Laid-Open Patent No. Showa 55-146847 discloses a CRT in which an electron gun corresponding to a position of an SVM coil is realized through at least two individual electrodes with a predetermined gap between the electrodes. The SVM coil is mounted to an outer circumference of a neck corresponding to a position of the gap (of the electron gun electrodes) such that a magnetic field generated by the SVM coil passes through the gap.

Although a sensitivity of the magnetic field can be enhanced with increases in gap size, such increases weaken the ability of the individual electrodes to focus electron beams as a result of an electrical field that enters from an exterior of the electrodes (e.g., an electrical field formed by a connector that electrically connects the individual electrodes). Therefore, there are limitations placed on how much the gap may be enlarged, and these limitations are such that the gap may not be made large enough to realize sufficient improvements in magnetic field sensitivity of the SVM coil. Stated differently, there are limits to how much the sensitivity of the magnetic field of the SVM coil can be increased.

Japanese Laid-Open Patent No. Heisei 2000-188607 discloses an electron gun in an effort to overcome these problems. In this patent, electrodes corresponding to a position of an SVM coil are formed in a coil configuration in an attempt to prevent a deterioration in the focusing of the electron beams by the influence of an exterior electric field, and to suppress eddy currents generated on the electrodes.

However, the coil-shaped electrodes are mounted along all directions perpendicular to an axial direction of the CRT such that although part of the magnetic field generated by the SVM coil acts on the coil-shaped electrodes, there is no substantial increase in the effect of the SVM coil with this configuration.

SUMMARY OF THE INVENTION

One exemplary embodiment of the present invention is an electron gun for a CRT having an SVM coil, and a CRT having the electron gun, in which the efficiency of using a magnetic field generated by the SVM coil is maximized, and a deterioration in focusing characteristics caused by an external electric field is prevented.

One exemplary embodiment of the present invention is an electron gun for a cathode ray tube including a scanning velocity modulation coil mounted on an outer circumference of a neck of the cathode ray tube includes a cathode for emitting an electron beam; a plurality of grid electrodes sequentially arranged starting from the cathode, and including a plurality of focus electrodes arranged with a predetermined gap therebetween; supports on which the plurality of grid electrodes are fixed in a row; and a shield electrode configured between the plurality of focus electrodes and connected to the plurality of focus electrodes. The shield electrode defines a continuous space along a long axis direction of the cathode ray tube.

The shield electrode includes at least one gap along a direction substantially perpendicular to the long axis direction of the cathode ray tube.

The shield electrode includes a pair of first and second shield electrodes provided opposing one another with a predetermined gap therebetween, and configured so as to form the space, the first and second shield electrodes closely contacting the focus electrodes and being fixed to the same.

The space is formed along a direction in line with the supports.

The first and second shield electrodes may be welded to the focus electrodes.

The first and second shield electrodes may each include a plurality of strips arranged at predetermined intervals, and connecting bars arranged between the strips for interconnecting adjacent strips.

The connecting bars may alternatingly be mounted to ends of the strips.

In one embodiment, if a width of the stripes is $W_1$, and a length of the gap is $W_2$, the following condition is satisfied, $$W_1<W_2.$$

Corners of the strips are formed at an angle, or may be rounded.

A combination of the first and second shield electrodes may be dome-shaped. Also, the strips and the connecting bars may be made of thin plates having predetermined thicknesses and widths, or of wires having a predetermined diameter.

The first and second shield electrodes are individually formed, or may be interconnected by a connector that extends from an end of the first shield electrode to an end of the second shield electrode.

In another exemplary embodiment, an electron gun for a cathode ray tube includes a scanning velocity modulation coil mounted on an outer circumference of a neck of the cathode ray tube includes a cathode for emitting an electron beam; a plurality of grid electrodes sequentially arranged starting from the cathode, and including a plurality of focus electrodes arranged with a predetermined gap therebetween; supports on which the plurality of grid electrodes are fixed in a row; and a shield electrode configured between the plurality of focus electrodes and connected to the plurality of focus electrodes, wherein the shield electrode forms a plurality of first slots formed in a direction substantially parallel to an elongated axis direction of the cathode ray tube, and a plurality of second slots formed along a direction that is different from the direction of the first slots.

The plurality of first slots are formed along the elongated axis of the cathode ray tube.

The plurality of second slots are formed at predetermined intervals and may be formed substantially transversed to the direction of the first slot.

In one embodiment, if a length of one of the slots in the plurality of first slots is $W_3$, and a width of one of the slots in the plurality of second slots is $W_4$, the following condition is satisfied, $$W_3>W_4.$$

The supports are formed within the first slots.

The shield electrode comprises a pair of opposing electrodes each formed in a meander pattern.

Each of the opposing electrodes of the shield electrode is formed having a cross section, taken along a plane perpendicular to the long axis of the cathode ray tube, that is arc shaped.

The shield electrode is mounted to an outer circumference of the focus electrodes.

BRIEF DESCRIPTION OF THE DRAWINGS

The accompanying drawings, which together with the specification illustrate exemplary embodiments of the present invention, and, together with the description, serve to explain the principles of the present invention.

DETAILED DESCRIPTION OF THE PREFERRED EMBODIMENTS

Exemplary embodiments of the present invention will now be described in detail with reference to the accompanying drawings.

Figure 1:
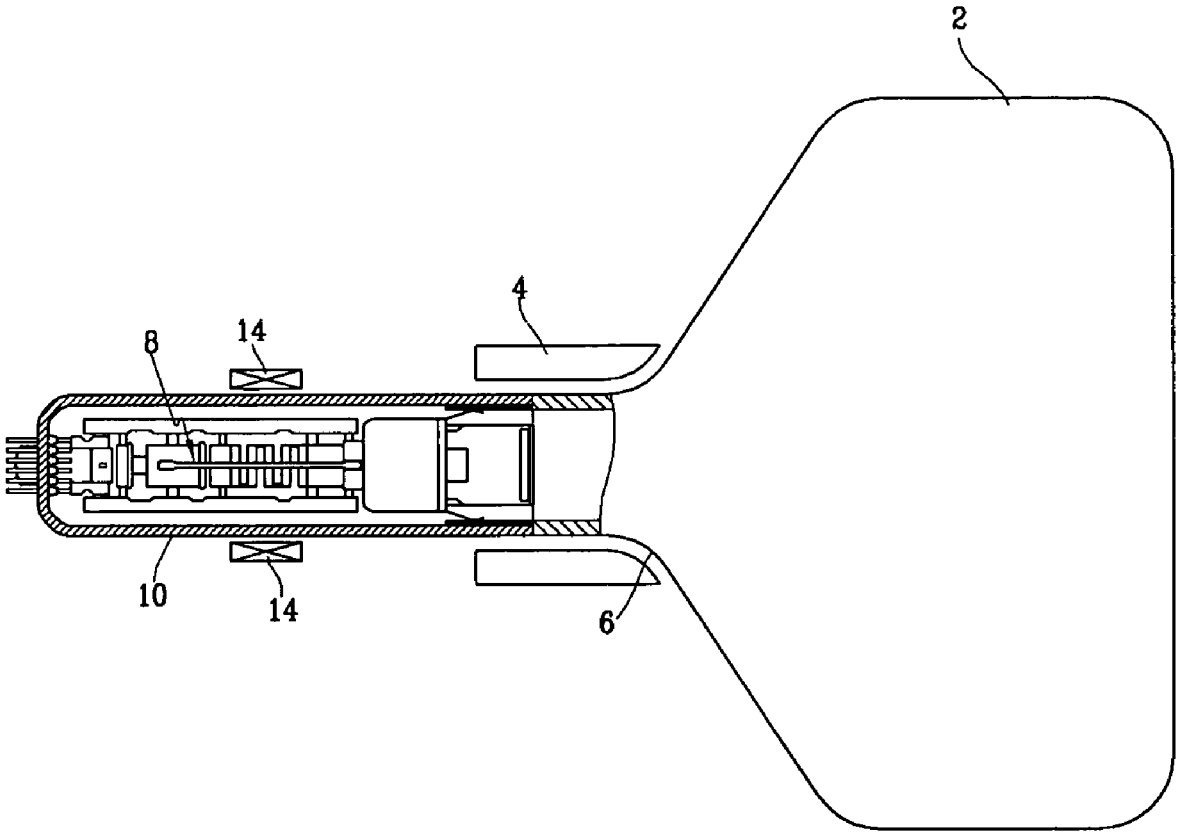
FIG. 1 is a partially cutaway sectional view of a cathode ray tube according to an embodiment of the present invention.
Figure 2:
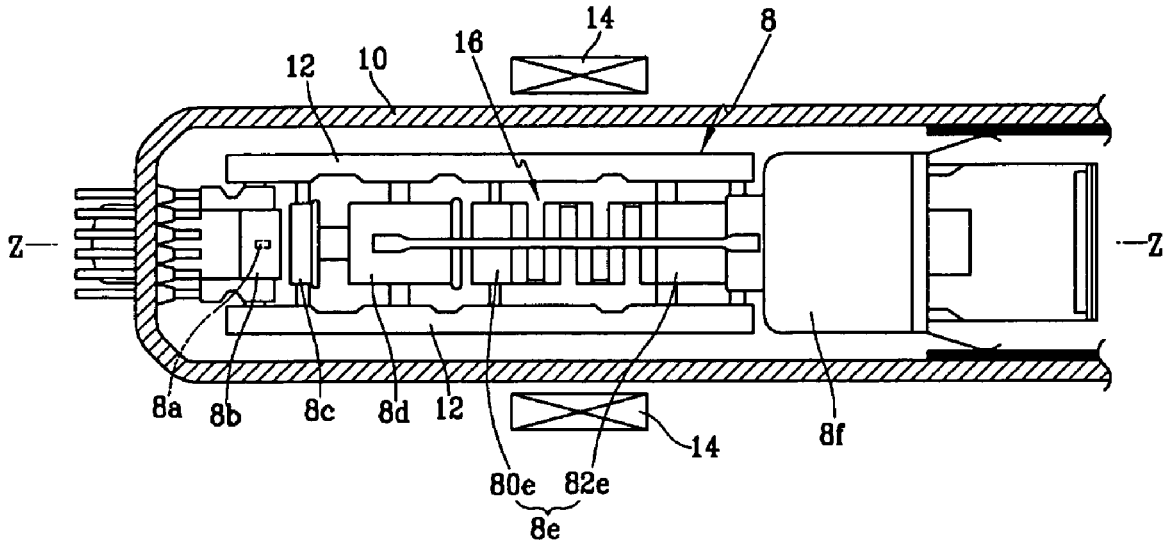
FIG. 2 is an enlarged partial sectional view of a neck of a cathode ray tube of FIG. 1.

FIG. 1 is a partially cutaway sectional view of a CRT according to an embodiment of the present invention, and FIG. 2 is an enlarged partial sectional view of a neck of the CRT shown in FIG. 1.

The CRT is a projection-type CRT (or monochrome CRT) that may be applied to a display device such as a projection television. Its structure, as with the conventional CRT, includes a panel 2 on an inside surface of which is formed a phosphor screen, a funnel 6 connected to the panel 2 with a deflection device 4 mounted to an outer circumference thereof for deflecting electron beams by generating a magnetic field, and a neck 10 connected to the funnel 6 and inside of which is mounted an electron gun 8 for emitting electron beams. The panel 2, the funnel 6, and the neck 10 are fused together to form a vacuum tube assembly.

The electron gun 8 generates a single electron beam, as opposed to the three beams generated by an electron gun in a color CRT. Referring now to FIG. 2, a structure is used so that the electron beam scans the phosphor screen. In more detail, the electron gun 8 includes a cathode 8*a*; a plurality of grid electrodes 8*b*, 8*c*, 8*d*, 8*e*, and 8*f* for controlling the electron beam emitted from the cathode 8*a*; and a pair of supports 12 on which the grid electrodes 8*b*–8*f* are fixed in a row.

The grid electrode 8*e* includes a plurality of focus electrodes with a predetermined gap therebetween. In this exemplary embodiment, the grid electrode 8*e* includes a first focus electrode 80*e* and a second focus electrode 82*e*. The first and second focus electrodes 80*e* and 82*e* are provided as individual units and are mounted with a predetermined gap therebetween. The CRT also includes an SVM coil 14 mounted to an outer circumference of the neck 10. The SVM coil 14 is mounted to the exterior of the neck 10 at a position corresponding to the gap between the first and second focus electrodes 80*e* and 82*e*.

In the CRT structured as discussed above, the following structure is used to maximize the efficiency at which the magnetic field generated by the SVM coil 14 is used, and to effectively prevent a deterioration in focusing caused by an external electric field.

A shield electrode 16 is mounted between and electrically connected to the focus electrodes 80*e* and 82*e*. The shield electrode 16 functions such that the electron beam passing through the focus electrodes 80*e* and 82*e* is not affected by an external electric field.

In one embodiment of the present invention, the shield electrode 16 is configured and mounted between the focus electrodes 80*e* and 82*e* in such a manner as to form a continuous space 17 along a long axis Z of the CRT. The space forms a type of columnar slot between the first and second focus electrodes 80*e* and 82*e*. For easy reference, the slot will subsequently be referred to as a first slot 18, shown in FIG. 3.

Figure 3:
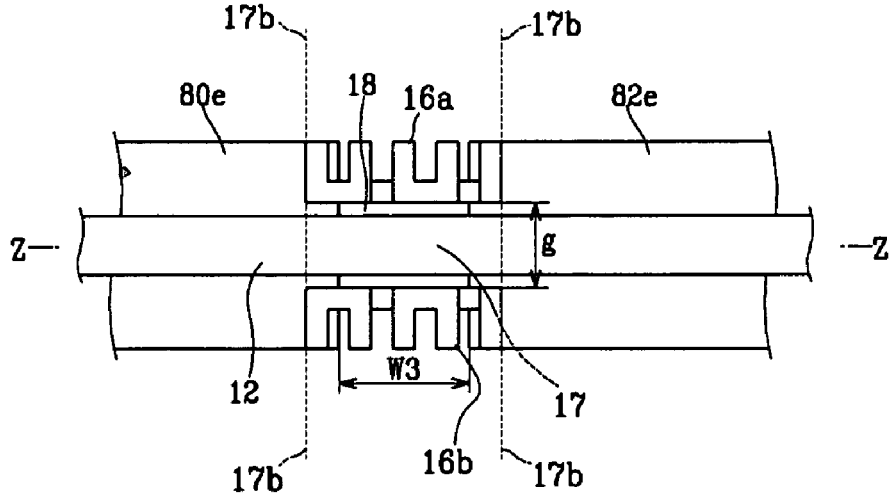
FIG. 3 is a partial side view of select element of an electron gun of FIG. 1.

The continuous space 17 refers to the space between the shield electrodes 16*a* and 16*b* (see FIG. 4) on the periphery of an imaginary cylinder configured between the imagery lines 17*a* and the pair of shield electrodes 16*a* and 16*b*, when they are brought together, that is the first slot 18, shown in FIG. 3. This space (slot) is continuous in that it traverses the full length of the electrodes 16*a* and 16*b*. Also, no obstacle exists within the space.

With reference to FIG. 3, the first slot 18 is extended along the long axis Z of the CRT, and the supports 12 are mounted within the first slot 18.

The first slot 18 is formed along the long axis Z as described above. The shield electrode 16, which forms the first slot 18, includes a pair of shield electrodes 16*a* and 16*b* (i.e., first and second shield electrodes, shown in FIGS. 4, 5B and 6). The first and second shield electrodes 16*a* and 16*b* are mounted opposing one another to thereby define the first slot 18 therebetween.

In the exemplary embodiment of the present invention, ends of the first shield electrode 16*a* and the second shield electrode 16*b* closely contact an outer circumference of the focus electrodes 80*e* and 82*e* and are fixed thereto by forming welds at the areas of contact. However, it is noted that this is just one example of the interconnection between these elements. For example, the ends of the first and second shield electrodes 16*a* and 16*b* may closely contact an inner circumference of the focus electrodes 80*e* and 82*e*, and the connection may be made using other methods besides welding.

Figure 4:
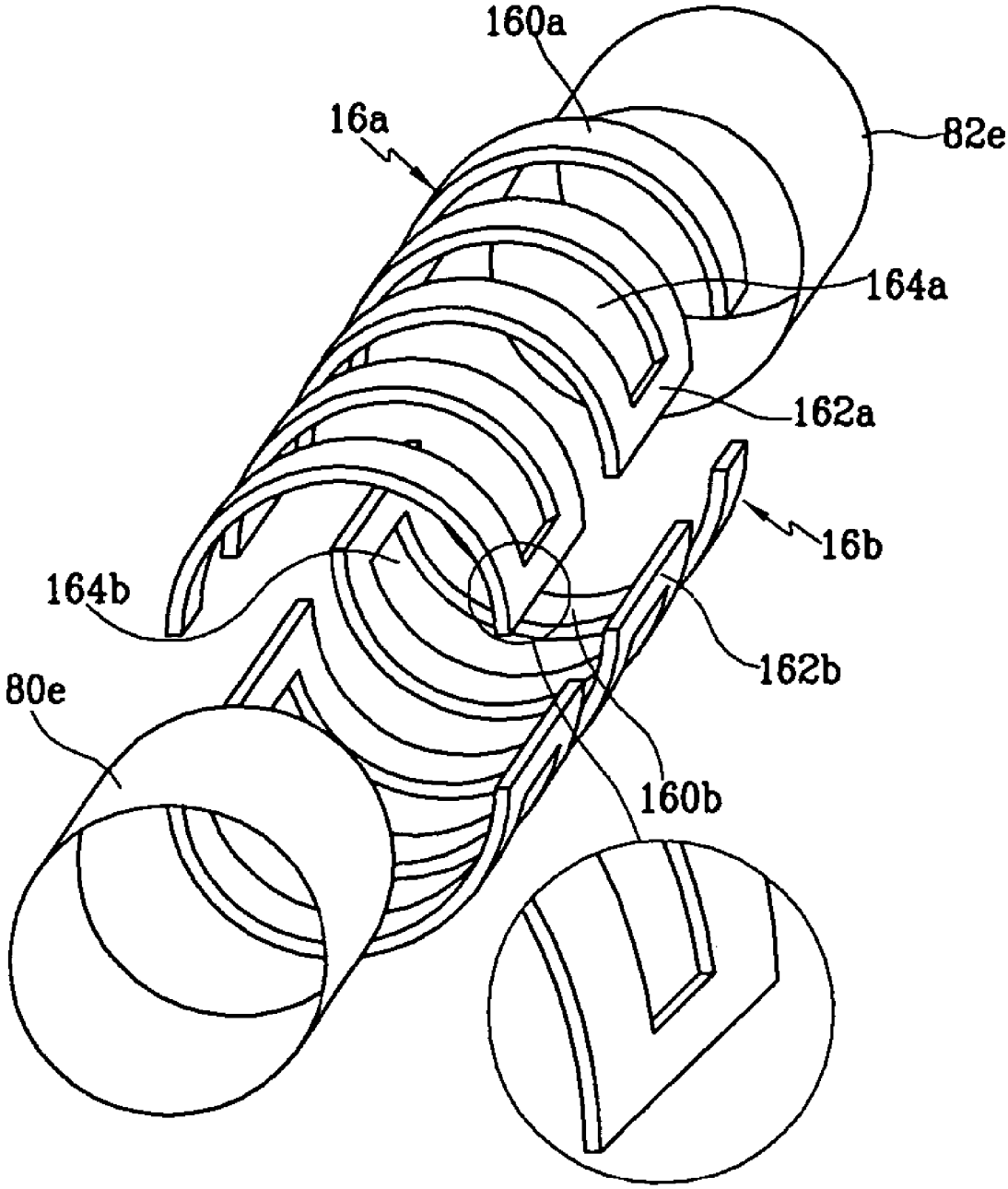
FIG. 4 is a partial side view of select element of an electron gun of FIG. 1.

FIG. 4 is an exploded perspective view showing the focus electrodes 80*e* and 82*e*, and the first and second shield electrodes 16*a* and 16*b* in a separated state. A detailed structure of these elements will be described below.

In particular, the focus electrodes 80*e* and 82*e* are cylindrical electrodes having an inner space defined therebetween.

The first shield electrode 16*a* is formed of a plurality of strips 160*a*, with connecting bars 162*a* interconnecting adjacent strips 160*a*. Similarly, the second shield electrode 16*b* is formed of a plurality of strips 160*b*, with connecting bars 162*b* interconnecting adjacent strips 160*b*. The connecting bars 162*a* and 162*b* interconnect ends of the strips 160*a* and 160*b*, respectively, in a state where adjacent strips 160*a* and 160*b* are at a predetermined distance from each other. Also, with respect to the first shield electrode 16*a*, one of the connecting bars 162*a* interconnects one of the ends of a pair of adjacent strips 160*a* and opposite ends of the next pair of adjacent strips 160*a*. This pattern is repeated for the entire shield electrode 16*a* and is also used for the second shield electrode 16*b*.

Using this connecting structure of the strips 160*a* and 160*b* and the connecting bars 162*a* and 162*b*, the overall shape of each of the first shield electrode 16*a* and the second shield electrode 16*b* is similar to that of the dome form, and when interconnected, the outer shape of the combined first and second shield electrodes 16*a* and 16*b* correspond to the shape of the focus electrodes 80*e* and 82*e*. A plan view is such that each of the first and second shield electrodes 16*a* and 16*b* is formed into a meandered pattern as shown in FIG. 5*b*. In addition, a cross section of each of the first shield electrode 16*a* and the second shield electrode 16*b* taken along a plane perpendicular to the long axis Z of the CRT is such that the resulting structure is an arc shape (see FIG. 5*a*). Corners of the ends of the strips 160*a* and 160*b* may be formed substantially at right angles as shown in FIG. 4, or may be rounded as shown in FIG. 6.

With this configuration, second slots 164*a* and 164*b* are formed in the spaces between the strips 160*a* and 160*b*, respectively. The second slots 164*a* and 164*b* are formed along a direction that is different from the direction along which the first slot 18 is formed. In the exemplary embodiments of the present invention, if a line is drawn through any two points in arcs formed by the second slots 164*a* and 164*b*, the line is substantially perpendicular to the long axis direction of the first slot 18.

Also, in the exemplary embodiments of the present invention, a width $W_3$ of the first slot 18 (FIG. 3) is greater than a width $W_4$ of the second slots 164*a* (FIG. 5*b*) and 164*b*, that is, $W_3>W_4$.

Figure 5A:
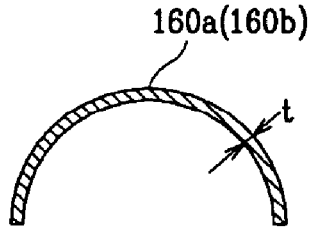
FIGS. 5*a* and 5*b* are respectively a side sectional view and a plan view of a shield electrode of FIG. 1.
Figure 5B:
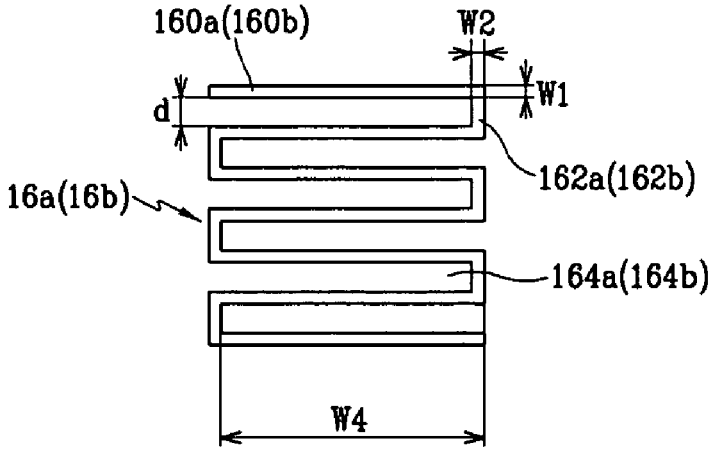
Figure 6:
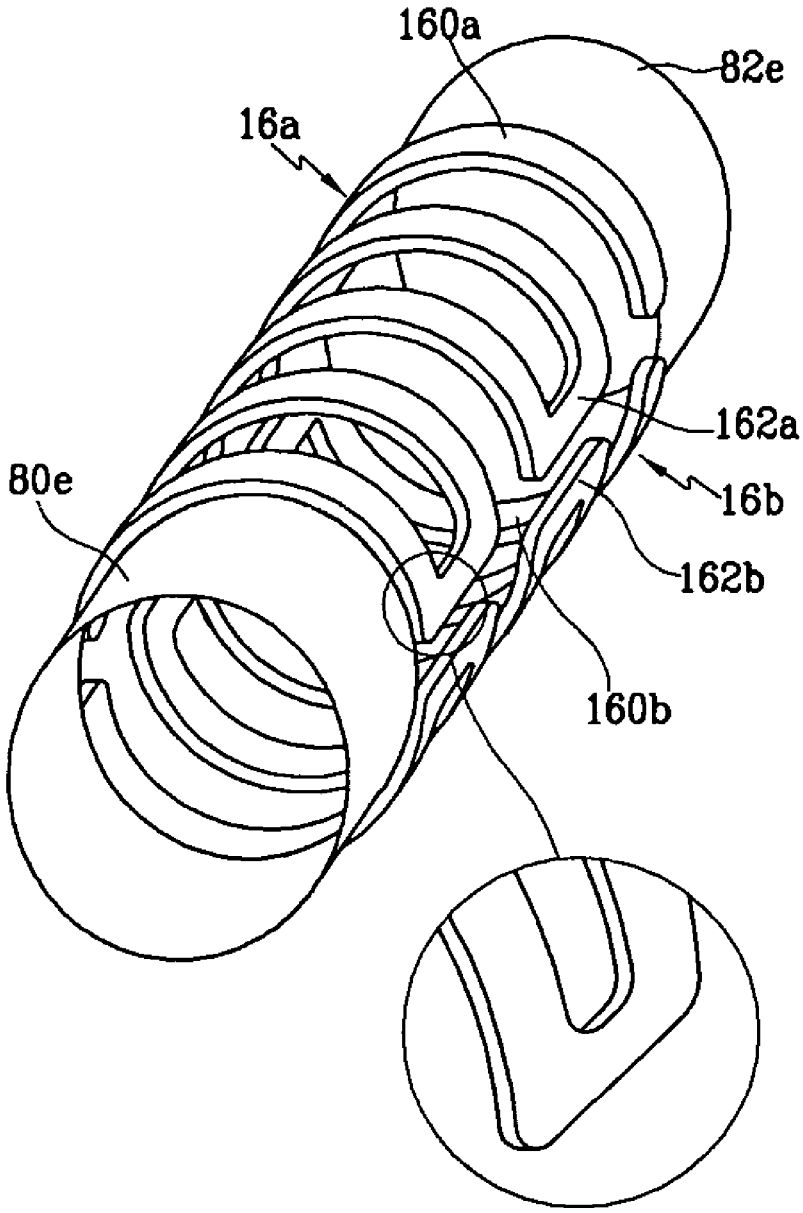
FIG. 6 is a perspective view of a shield electrode according to another exemplary embodiment of the present invention.

In addition, in this exemplary embodiment of the present invention, the strips 160*a* and 160*b*, and the connecting bars 162*a* and 162*b* of the first and second shield electrodes 16*a* and 16*b*, are made of thin plate members having a predetermined thickness t and widths $W_1$ and $W_2$(see FIGS. 5*a* and 5*b*). The thickness t of the thin plate members is in the range of 0.2~1.0 mm, and the widths $W_1$ and $W_2$ are in the range of 0.3~1.5 mm. Preferably, a distance (d) between adjacent strips 160*a* and 160*b* is in the range of 0.3~2.0 mm. In one embodiment, the width $W_1$ of the strips 160*a* and the width $W_2$ of the connecting bars 162*a* and 162*b* satisfy the following condition, $$W_1<W_2.$$

These dimensions of the first and second shield electrodes 16*a* and 16*b* are those determined through repeated tests performed by the inventors to provide optimal structural strength to the shield electrode 16 and usage efficiency of the SVM coil 14 (i.e., efficiency in using the magnetic field generated by the SVM coil 14).

In the CRT structured as in the above, the phosphor screen formed on the inner surface of the panel 2 is illuminated by the electron beams emitted by the electron gun 8 to thereby produce specific images. The magnetic field generated by the SVM coil 14 during this process controls the electron beam passing through the first slot 18 and the second slots 164*a* and 164*b* of the shield electrode 16, and through the focus electrodes 80*e* and 82*e*.

The magnetic field generated by the SVM coil 14 easily reaches the scanning path of the electron beam by passing into the first slot 18 and through the second slots 164*a* and

164*b* of the shield electrode 16. In addition, a surface area of the shield electrode 16 may be optimized by the first slot 18 and the second slots 164*a* and 164*b* such that an eddy current formed on the surface thereof may be minimized, thereby allowing the efficiency in using the magnetic field generated by the SVM coil 14 to be maximized.

Furthermore, the combination of the first and second shield electrodes 16*a* and 16*b* of the shield electrode 16 is dome-shaped as described above, to correspond to the shape of the focus electrodes 80*e* and 82*e*. This allows easy welding of the shield electrode 16 to the focus electrodes 80*e* and 82*e*.

In addition, since it is unnecessary for the shield electrode 16 to be elastic as with the conventional coil-type shield electrode, heat treating of the shield electrode 16 is possible to thereby improve the ability of the same to withstand voltage.

A height of the first slot 18, that is, a gap (g) between the first and second electrodes 16*a* and 16*b* affects the degree to which the magnetic field generated by the SVM coil 14 influences the electron beam and the amount of deterioration in the path of the electron beam caused by an external electric field. It was determined through repeated testing by the inventors that it is preferable that the gap (g) does not reach or exceed 4 mm.

Figure 7:
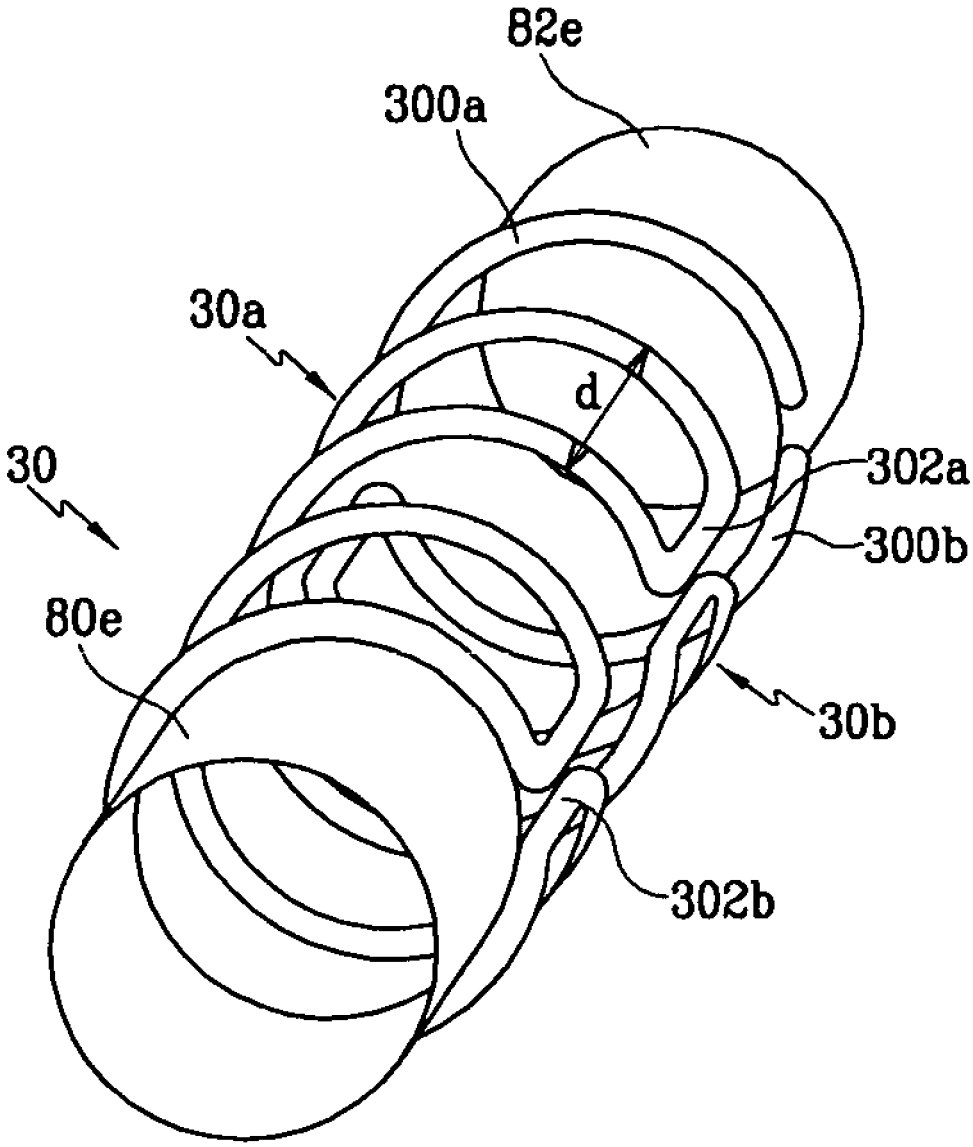
FIG. 7 is a perspective view used to illustrate a shield electrode according to yet another exemplary embodiment of the present invention.

Additional exemplary embodiments of the present invention will now be described. FIG. 7 is a perspective view used to describe a shield electrode according to another exemplary embodiment of the present invention. A shield electrode 30 according to this exemplary embodiment of the present invention is made of a material formed in the shape of a wire, as opposed to being formed of a material in the shape of a thin plate.

The shield electrode 30 includes first and second shield electrodes 30*a* and 30*b*. The first shield electrode 30*a* is formed of a plurality of strips 300*a*, with connecting bars 302*a* interconnecting adjacent strips 300*a*. Similarly, the second shield electrode 30*b* is formed of a plurality of strips 300*b*, with connecting bars 302*b* interconnecting adjacent strips 300*b*. Taking into consideration strength and ease of manufacture of the shield electrode 30, it is preferable that a diameter of the wires forming the first and second shield electrodes 30*a* and 30*b* is in the range of 0.3~1.5 mm, and a distance (d) between the strips is in the range of the 0.3~2.0 mm.

Figure 8:
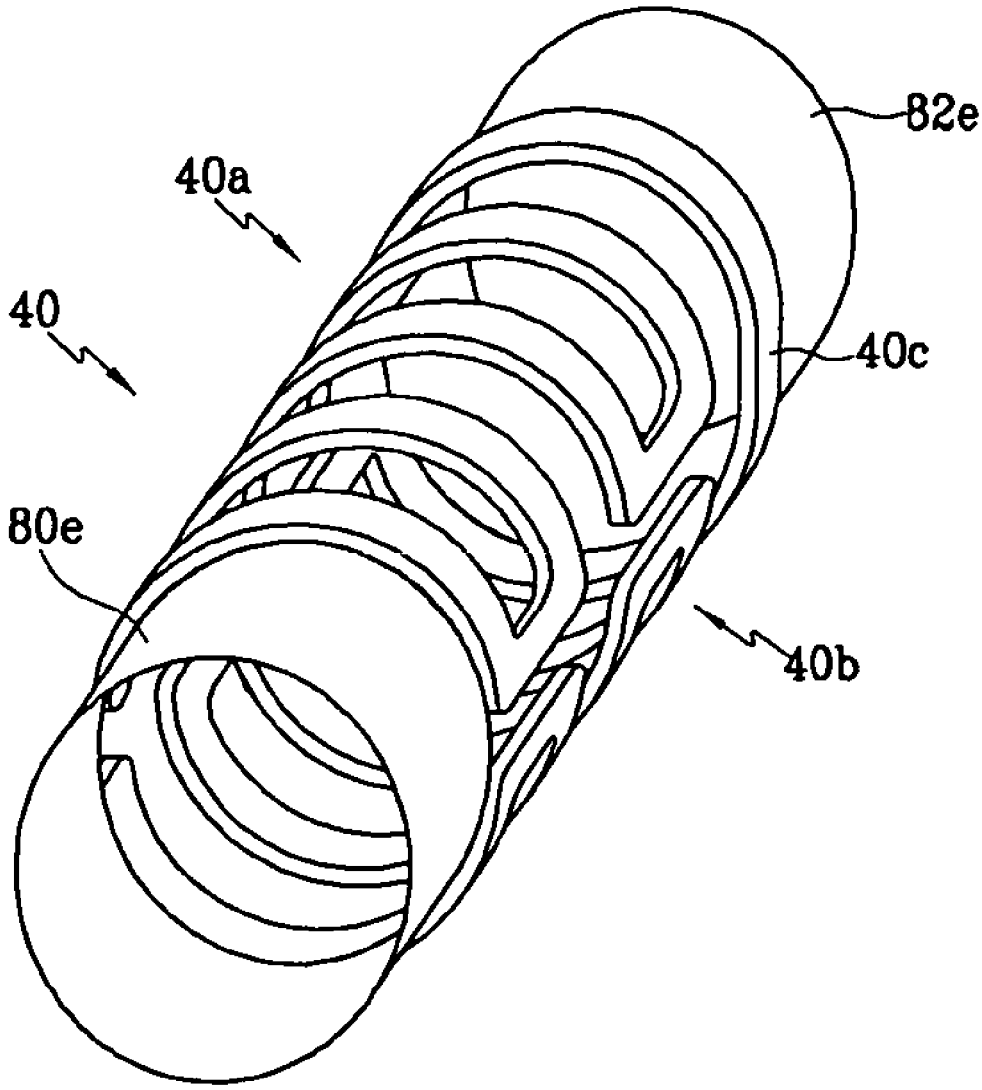
FIG. 8 is a perspective view used to illustrate a shield electrode according to still yet another exemplary embodiment of the present invention.
Figure 9:
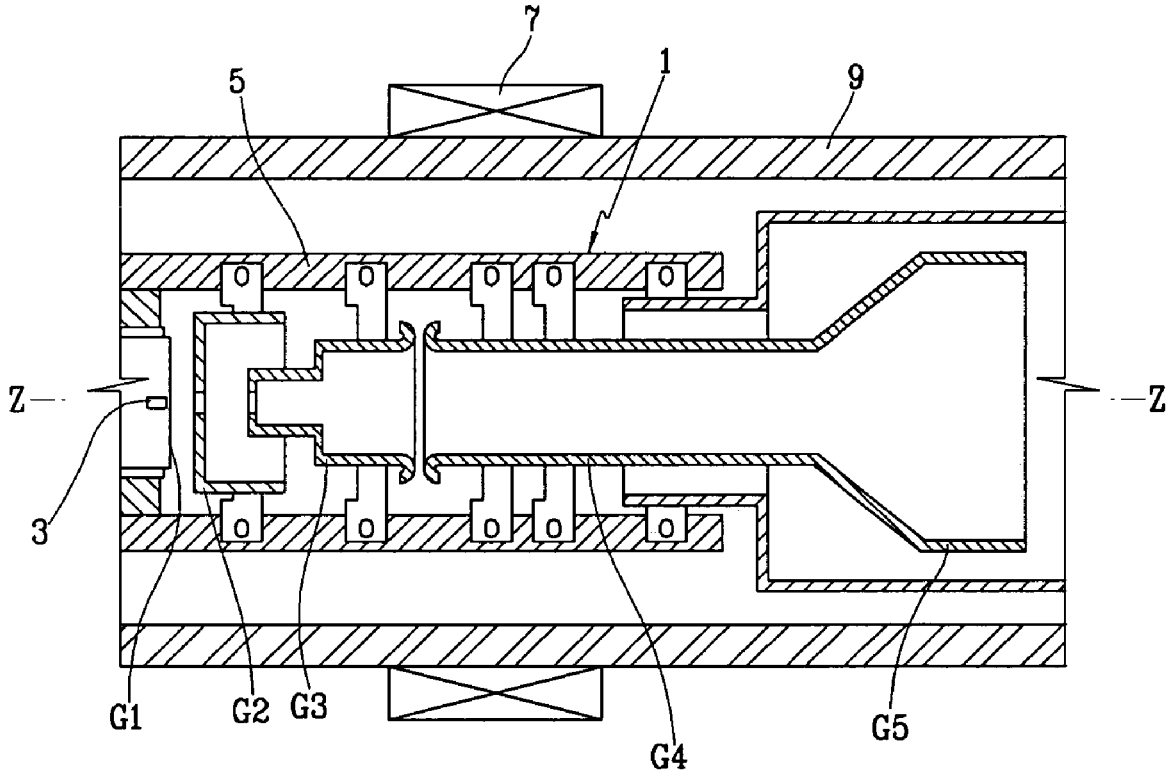
FIG.9(Prior Art)
FIG. 9 is a partial sectional view showing a conventional structure of a CRT having an SVM coil.

FIG. 8 is a perspective view used to describe a shield electrode according to yet another exemplary embodiment of the present invention. A shield electrode 40 has the basic structure of the shield electrodes described above. However, at least one end of a first electrode 40*a* and one end of a second electrode 40*b* comprising the shield electrode 40 are interconnected by a connector 40*c*.

Further, although not shown in the drawings, it is possible for the shield electrode to be formed by the combination of a plurality of strips in a zigzag pattern.

In the CRT of the present invention described above, the structure or the shield electrode is improved such that the sensitivity to a magnetic field generated by the SVM coil is increased and the negative effect on focusing characteristics of the electror beam caused by an external electric field is prevented, thereby improving the resolution around edges of the image realized on the phosphor screen.

In addition, since it is possible to heat treat the shield electrode, its ability to withstand higher voltages may be improved. Also, the formation of the shield electrode to a shape corresponding to the structure of the focus electrodes allows for easy connection between these elements using, for example, a welding process, thereby improving productivity.

Although embodiments of the present invention have been described in detail hereinabove in connection with certain exemplary embodiments, it should be understood that the invention is not limited to the disclosed exemplary embodiments, but, on the contrary is intended to cover various modifications and/or equivalent arrangements included within the spirit and scope of the present invention, as defined in the appended claims.

What is claimed is:

1. An electron gun for a cathode ray tube including a scanning velocity modulation coil mounted on an outer circumference of a neck of the cathode ray tube, the electron gun comprising:

a cathode for emitting an electron beam;

a plurality of grid electrodes sequentially arranged starting from the cathode, and including a plurality of focus electrodes arranged with a predetermined gap therebetween;

a support on which the plurality of grid electrodes are fixed in a row; and a shield electrode configured between the plurality of focus electrodes and connected to the plurality of focus electrodes, wherein the shield electrode comprises a pair of first and second shield electrodes opposing one another with at least two gaps in between, each of the gaps forming a continuous space between the first and second shield electrodes along a long axis direction of the cathode ray tube.

2. The electron gun of claim 1, wherein the shield electrode includes at least one gap along a direction substantially perpendicular to the long axis direction of the cathode ray tube.

3. The electron gun of claim 1, wherein the first and second shield electrodes closely contact the plurality of focus electrodes and are fixed to the same.

4. The electron gun of claim 3, wherein the space is formed along a direction in line with the support.

5. The electron gun of claim 4, wherein the first and second shield electrodes are welded to the plurality of focus electrodes.

6. The electron gun of claim 5, wherein the first and second shield electrodes are mounted to an outer circumference of the focus electrodes.

7. The electron gun of claim 3, wherein the first and second shield electrodes each include a plurality of strips arranged at predetermined intervals, and connecting bars arranged between the strips for interconnecting adjacent strips.

8. The electron gun of claim 7, wherein the connecting bars are alternatingly mounted to ends of the strips.

9. The electron gun of claim 7, wherein the width of the strips is $W_1$ and the length of the gap is $W_2$, and the following condition is satisfied, $W_1<W_2$.

10. The electron gun of claim 7, wherein corners of the strips are formed at an angle.

11. The electron gun of claim 7, wherein corners of the strips are rounded.

12. The electron gun of claim 7, wherein the strips and the connecting bars are made of thin plates having predetermined thicknesses and widths.

13. The electron gun of claim 12, wherein the thickness of the strips and the connecting bars are each in the range of 0.2~1.0 mm.

14. The electron gun of claim 12, wherein the widths of the strips and the connecting bars are each in the range of 0.3~1.5 mm.

15. The electron gun of claim 12, wherein a distance between adjacent strips is in the range of 0.3~2.0 mm.

16. The electron gun of claim 7, wherein the strips and the connecting bars are made of wires having a predetermined diameter.

17. The electron gun of claim 16, wherein the diameter of the wires is in the range of 0.3–1.5 mm.

18. The electron gun of claim 16, wherein a distance between adjacent strips is in the range of 0.3–2.0 mm.

19. The electron gun of claim 3, wherein the first and second shield electrodes are dome-shaped.

20. The electron gun of claim 3, wherein the first and second shield electrodes are individually formed.

21. The electron gun of claim 3, wherein the first and second shield electrodes are interconnected by a connector that extends from an end of the first shield electrode to an end of the second shield electrode.

22. A cathode ray tube comprising an electron gun formed as in claim 1.

23. An electron gun for a cathode ray tube including a scanning velocity modulation coil mounted on an outer circumference of a neck of the cathode ray tube, the electron gun comprising:

a cathode for emitting an electron beam;

a plurality of grid electrodes sequentially arranged starting from the cathode, and including a plurality of focus electrodes arranged with a predetermined gap therebetween;

a support on which the plurality of grid electrodes are fixed in a row; and a shield electrode configured between the plurality of focus electrodes and connected to the plurality of focus electrodes, wherein the shield electrode comprises a pair of opposing electrodes leaving a plurality of first slots in between, each of the first slots forming a continuous space between the pair of opposing electrodes in a direction substantially parallel to a long axis direction of the cathode ray tube, and wherein each of the opposing electrodes includes a plurality of second slots formed along a direction different from the direction of the first slots.

24. The electron gun of claim 23, wherein the plurality of second slots are formed at predetermined intervals and are formed substantially transverse to the direction of the plurality of first slots.

25. The electron gun of claim 23, wherein the length of one of the slots in the plurality of first slots is $W_3$, and the width of one of the slots in the plurality of second slots is $W_4$, and the following inequality is satisfied, $W_3>W_4$.

26. The electron gun of claim 23, wherein the supports are formed within the first slots.

27. The electron gun of claim 23, wherein the pair of opposing electrodes are each formed in a meandered pattern.

28. The electron gun of claim 27, wherein each of the opposing electrodes of the shield electrode is formed having a cross section, taken along a plane perpendicular to the elongated axis of the cathode ray tube, that is arc shaped.

29. The electron gun of claim 27, wherein the shield electrode is welded to the plurality of focus electrodes.

30. The electron gun of claim 29, wherein the shield electrode is mounted to an outer circumference of the plurality of focus electrodes.

31. The electron gun of claim 27, wherein the shield electrode is made of one of thin plates and wires.

32. A cathode ray tube comprising an electron gun formed as in claim 23.

* * * * *

UNITED STATES PATENT AND TRADEMARK OFFICE

CERTIFICATE OF CORRECTION

PATENT NO. : 7,135,814 B2
APPLICATION NO. : 11/068635
DATED : November 14, 2006
INVENTOR(S) : Jung et al.

It is certified that error appears in the above-identified patent and that said Letters Patent is hereby corrected as shown below:

On the Title Page

| | |
|---|---|
| (56) References Cited<br>Other Publication | Delete "Publication No. 55-1468847",<br>Insert --Publication No. 55-146847-- |

In the Claims

| | |
|---|---|
| Column 8, line 65, | Delete "thickness",<br>Insert --thicknesses-- |
| Column 9, line 10, | Delete "0.3-1.5",<br>Insert --0.3~1.5-- |
| Column 9, line 12, | Delete "0.3-2.0",<br>Insert --0.3~2.0-- |

Signed and Sealed this

Twenty-fourth Day of July, 2007

JON W. DUDAS
*Director of the United States Patent and Trademark Office*